US005622773A

United States Patent [19]

Reiner et al.

[11] Patent Number: 5,622,773

[45] Date of Patent: Apr. 22, 1997

[54] PROCESS FOR PLASMA TREATMENT OF ANTIBALLISTICALLY EFFECTIVE MATERIALS

[75] Inventors: Andreas Reiner, Sulzbach; Dieter H. P. Schuster; Achim G. Fels, both of Wuppertal, all of Germany

[73] Assignee: Akzo Nobel NV, Arnhem, Netherlands

[21] Appl. No.: 387,923

[22] PCT Filed: Aug. 3, 1994

[86] PCT No.: PCT/EP94/02572

§ 371 Date: Apr. 6, 1995

§ 102(e) Date: Apr. 6, 1995

[87] PCT Pub. No.: WO95/04854

PCT Pub. Date: Feb. 16, 1995

[30] Foreign Application Priority Data

| | | | |
|---|---|---|---|
| Aug. 7, 1993 | [DE] | Germany | 43 26 555.3 |
| Jul. 9, 1994 | [DE] | Germany | 44 24 320.0 |

[51] Int. Cl.[6] ..... D03D 3/00

[52] U.S. Cl. ..... 442/135; 2/2.5; 264/483; 428/902; 428/911; 442/188; 442/307; 442/333

[58] Field of Search ..... 428/911, 225, 428/224, 253, 902; 2/2.5; 264/483

[56] References Cited

U.S. PATENT DOCUMENTS

| | | | |
|---|---|---|---|
| 3,740,325 | 6/1973 | Manion et al. | 204/169 |
| 4,310,564 | 1/1982 | Imada et al. | 427/40 |
| 4,902,529 | 2/1990 | Rebhan et al. | 427/37 |

FOREIGN PATENT DOCUMENTS

| | | |
|---|---|---|
| 1122566 | 4/1982 | Canada . |
| 0168131 | 1/1986 | European Pat. Off. . |
| 0192510 | 8/1986 | European Pat. Off. . |
| 0191680 | 8/1986 | European Pat. Off. . |
| 0492649 | 7/1992 | European Pat. Off. . |
| 63-223043 | 9/1988 | Japan . |

OTHER PUBLICATIONS

Derwent Abstract of JP–A 59–179874 (Oct. 12, 1994).

Derwent Abstract of JP–A 62–083007 (Apr. 16,1987).

Derwent Abstract of JP–A 03–014677 (Jan. 23, 1991).

Brown et al., "Plasma Surface Modification of Advanced Organic Fibres," *Journal of Materials Science* 26, Aug. 1, 1991, No. 15, pp. 4172–4178.

Wang et al., "Catalytic Grafting: A New Technique for Polymer–Fiber Composites. III. Polyethylene–Plasma–Treated Kevlar(TM) Fibers Composites: Analysis of the Fiber Surface," *Journal of Applied Polymer Science* 48, Apr. 5, 1993, No. 1, pp. 121–136.

*Primary Examiner*—James J. Bell
*Attorney, Agent, or Firm*—Oliff & Berridge

[57] ABSTRACT

Two-stage process for plasma treatment of antiballistically effective materials such as aromatic polyamides. The first stage includes a plasma treatment with at least 50% inorganic gas or a mixture of inorganic gases, and the second phase includes a plasma treatment with a hydrophobically acting organic gas or mixtures of such gases from the group of saturated hydrocarbons, unsaturated hydrocarbons, saturated fluorocarbons, unsaturated fluorocarbons, siloxanes, or vinyl compounds. In the second stage, a mixture of one or more inorganic gases with one or more hydrophobically acting organic gases can also be used. The process improves antiballistic effectiveness.

20 Claims, No Drawings

PROCESS FOR PLASMA TREATMENT OF ANTIBALLISTICALLY EFFECTIVE MATERIALS

FIELD OF THE INVENTION

The invention relates to a continuous or discontinuous process for plasma treatment of antiballistically effective materials.

BACKGROUND

Many plasma treatments have been described for various polymers, whereby a number of quite different plasmas have been suggested. Frequently, plasmas of noble gases are specified, but oxygen and nitrogen plasmas also are used. The aim of plasma treatment is usually to modify the surface of the polymers with the objective of improving adhesion of coating or finishing agents. A further, often described treatment objective is an improvement in dye affinity.

The literature also cites treatable polymers that can be employed for antiballistically effective materials, such as aromatic polyamide fibers or polyethylene fibers spun using the gel spinning process. In the plasma treatment of these fibers as well, changes in properties, as noted above, are always the focus of attention.

Combined treatments are sometimes suggested, comprising pretreatment in a plasma followed by wet treatment by dip impregnation with various finishing agents.

For example, JP-A 63-223 043 describes a treatment of aromatic polyamide fibers in an argon, oxygen, or nitrogen plasma. This is followed by a treatment with a gaseous or liquid mixture of dienes and compounds containing glycidyl groups. The aim is to improve the dyeing characteristics of the fibers and the adhesion of finishing agents to the fiber surface.

Additional two-stage processes with a plasma pretreatment of aromatic polyamide fibers and a subsequent wet treatment by dip impregnation, such as with polymerizable substances, are described in EP-A 191 680, EP-A 192 510, and CA-A 1 122 566. In all these processes, an improvement in the adhesion of coating or finishing agents is sought by modifying the surface via plasma treatment.

Although these processes allow good adhesion between the base material, made from aromatic polyamide fibers, and the finishing or coating agent, they are very cost-ineffective due to the requirement for treatment in two very different apparatuses (plasma treatment for the first stage and dip or coating apparatus for the second stage). Furthermore, the wet treatments of the second stage are questionable on ecological grounds.

A plasma treatment for a series of very different fiber materials is described in EP-A 492 649. This case involves treatment in a plasma of polymerizable gases, including alkenes and fluorinated alkenes. These gases are possibly "diluted" with noble gases. The objective of the treatment is an improvement of the dyeing characteristics and a positive influence on the working properties of sewing threads.

A combined plasma treatment of polyethylene with noble gases and fluorocarbons is described in U.S. Pat. No. 3,740,325. In this case, the objective is to improve the corrosion resistance by means of plasma treatment.

None of these processes indicates how plasma treatment of antiballistically effective materials must be conducted.

The improvement of the antiballistic effect is a continuing objective of manufacturers of clothing protecting against bullets and splinters as well as of suppliers of the materials employed. It must be noted that an improvement of the antiballistic effect is sought not only in the dry state but that this effect, especially with respect to the requirements of protective clothing for military applications, must be continually improved in the wet state as well.

To satisfy the demands for good antiballistic efficacy in the wet state, flat-shaped structures made from aromatic polyamide fibers have frequently been subjected to bath treatment with hydrophobically acting agents, particularly fluorocarbon compounds. Aside from the expense required for the bath treatment and subsequent drying, a wet treatment with such compounds is also questionable ecologically.

The object is therefore to develop a cost-effective process that improves the antiballistic effectiveness in the dry and, particularly, the wet state while offering the opportunity to dispense with the heretofore employed wet treatment.

SUMMARY OF THE INVENTION

Surprisingly, it has now been discovered that this objective can be met if a plasma treatment of the antiballistically effective materials is performed in a two-stage process. In the first stage, treatment occurs in a plasma consisting of at least 50% inorganic gas or a mixture of inorganic gases. The second stage comprises treatment in a plasma of hydrophobically acting organic gases or mixtures of such gases from the group of saturated hydrocarbons, unsaturated hydrocarbons, saturated fluorocarbons, unsaturated fluorocarbons, siloxanes, or vinyl compounds. The treatment in the second stage can also be accomplished using a mixture of hydrophobically acting organic gases with inorganic gases.

DETAILED DESCRIPTION OF PREFERRED EMBODIMENTS

The plasma treatment in accordance with the process of the invention can employ oxygen, nitrogen, hydrogen, as well as noble gases such as argon, helium, xenon, and krypton. Among the noble gases, argon and helium are preferred. Especially preferred is treatment in an argon plasma. In addition, mixtures of the inorganic gases can be used. Likewise, mixtures of inorganic gases with organic gases can be employed, but the fraction of inorganic gases must be at least 50% in each case. Preferred among the organic gases are the hydrophobically acting gases also contemplated for the second treatment stage.

Depending on the desired effect, the flow rates of the inorganic gas or the gas mixtures introduced into the plasma chamber are between 1 ml/min and 500 ml/min, preferably between 5 ml/min and 200 ml/min, and most preferably between 10 ml/min and 50 ml/min. These values are based on a plasma chamber volume of 20 l. For other chamber volumes, the flow rates can be converted accordingly. If the chamber geometry deviates significantly, the flow rates may have to be reestablished experimentally.

By means of the plasma treatment with an inorganic gas or a gas mixture with at least 50% inorganic gas in the first treatment stage, the surface of the polymer is activated and thus conditioned for the subsequent treatment with a hydrophobically acting organic gas.

The hydrophobically acting organic gases for the plasma treatment in accordance with the process of the invention in the second stage include saturated hydrocarbon compounds, unsaturated hydrocarbon compounds, saturated fluorocarbon compounds, unsaturated fluorocarbon compounds, siloxanes, or vinyl compounds, or mixtures of the cited compounds.

Saturated and unsaturated hydrocarbon compounds include those from the groups of alkanes, alkenes, alkines, dienes, trienes, and cumulenes. The process of the invention can be conducted either with hydrocarbon compounds of the cited groups or with corresponding compounds in which fluorine atoms have been substituted for one or more hydrogen atoms. Unsaturated compounds are preferred for carrying out the process of the invention.

Examples of gases in the alkane series are compounds with the general formula $C_nH_{2n+2}$, where n=1–10.

Gases from the alkene series can include ethene, propene, butene, hexene, or heptene. Examples of suitable alkines are acetylene and diacetylene. Among the dienes, the use of butadiene is preferred. Other suitable compounds are pentadiene and hexadiene. An example of a gas from the triene class is hexatriene.

Suitable saturated fluorocarbon compounds are, for example, tetrafluoromethane and hexafluoroethane. Examples of well suited unsaturated fluorocarbon compounds are tetrafluoroethylene and hexafluorobutadiene.

Examples of siloxanes are tetramethyldisiloxane and hexamethyldisiloxane.

Examples of vinyl compounds are styrene, divinylbenzene, and hydrophobic acrylic compounds. The latter can comprise methyl, ethyl, or butyl acrylates.

The citing of suitable compounds is not to be considered limiting, but rather simply as a list of examples.

It is clear that especially those hydrophobizing compounds are preferred that are gaseous at room temperature. However, hydrophobically acting compounds that are not gaseous at room temperature can be used if they have a sufficiently high vapor pressure. For example, hydrophobic liquids can be connected to the vacuum of the plasma reactor if they satisfy the requirements with respect to vapor pressure, whereby the liquid vaporizes and is then present in the plasma reactor as a hydrophobically acting gas.

An additional possibility to introduce hydrophobic compounds which are liquid at room temperature consists of conducting a gas, for example an inorganic gas, through the liquid, whereby the gas becomes saturated with molecules of the liquid. When introducing the gas into the plasma reactor, the entrained molecules of the liquid are subjected to the plasma.

In the second treatment stage, the treatment can also be conducted with a mixture of hydrophobically acting organic gases and inorganic gases, whereby the fraction of organic gases preferably exceeds 50%. The previously mentioned gases also can be used in this case. Such mixtures can be used in a suitable manner if the hydrophobically acting organic compound is liquid at room temperature.

If mixtures of hydrophobically acting organic gases are used in the second stage, there are no restrictions with respect to the mixture ratios. The type of mixture and fractions of individual gases depend on the desired effect.

For the second treatment stage, the gas volumes introduced to the plasma chamber are in the same ranges as for the first treatment stage. The volumes cited for the first stage can also apply in this case.

The reactions occurring in plasma treatment with a hydrophobically acting organic gas or with mixtures of such gases are not yet fully understood. A polymerization of these gases is probably triggered on the polymer surface activated by the treatment with a noble-gas plasma. For monomers with double bonds, for example unsaturated hydrocarbons such as alkenes or dienes, this polymerization occurs in the known manner. The processes of polymerization with saturated hydrocarbons have not yet been sufficiently clarified. In this case, probably due to partial cracking, radicals with double bonds are generated, which are capable of polymerization.

In addition to the polymerization reaction, however, there may also be an exchange of atoms between the plasma gas and the substrate being treated. When using a plasma of gases containing fluorine, H atoms of the benzene ring of an aromatic polyamide can be replaced by F atoms.

It is also not yet clear whether the observed positive effect on the antiballistic properties is due solely to the formation of a polymer film on the surface of the antiballistically effective material or whether other processes, such as a modification of the surface of the antiballistically effective materials, play a role in this case.

The two-stage treatment can, for example, be conducted in two series-connected plasma chambers, which can be located in one reactor. Likewise, two series-connected reactors, each with one chamber, can be used. Finally, it is also possible to conduct the two-stage plasma treatment in the same chamber with immediately consecutive processes, i.e., without ventilation of the chamber.

The antiballistically effective materials can be treated in various makeup forms. In the interest of a continuous process, web-type flat-shaped structures such as sheets, woven fabrics, knitted fabrics, or non-wovens are appropriate. In the same manner, yarn sheets can also be used. The latter can be used, for example, for plasma treatment of the freshly spun fibers, that is, the process of the invention can also be combined with a fiber manufacturing process. In the same manner, combinations of the process of the invention with other treatment steps can also be carried out with other makeup forms of the material being treated, such as sheets, woven fabrics, knitted fabrics, or non-wovens.

In addition, it is also possible to subject individual fibers or yarns, and slivers, to a plasma treatment. The slivers can comprise card or drawing-frame slivers, worsted tops, or rovings. Likewise, tows can also be treated. With these makeup forms as well, a plasma treatment can be integrated into various manufacturing processes, such as fiber manufacture. For example, after passing the washing and drying zones, the freshly spun aromatic polyamide fibers can be subjected to a continuous plasma treatment using the process of the invention.

The web- or fiber-form materials mentioned previously are suited to continuous treatment, which is preferred for carrying out the process of the invention. On the other hand, the process of the invention can also be conducted discontinuously, whereby the two treatment stages are conducted in the same treatment chamber or in two different treatment chambers. For discontinuous treatment, any desired makeup form can be used. It is especially appropriate for the treatment of cutouts for the antiballistic protective layers of bullet- or splinter-proof vests.

The antiballistically effective materials include primarily aromatic polyamide fibers, also known as aramid fibers. Such fibers are commercially available under trade names such as Twaron, for example. In addition, aromatic polyamides in non-fiber form, such as sheets, can be present. The aromatic polyamides include polymers that are produced by polycondensation of aromatic diamines with aromatic dicarboxylic acids. However, aromatic polyamides also include the polymers that contain fractions of aliphatic compounds in addition to aromatic compounds.

Also included among the antiballistically effective materials are polyolefin fibers, in particular polyethylene fibers spun using the gel spinning process. Aromatic polyamides are especially suitable for implementing the process of the invention.

Aromatic polyamides are employed preferably in the form of fibers in very different areas of the clothing and other industries. They are used, among other things, for manufacturing bullet- and splinter-resistant clothing, in which the actual protective layer forms a so-called antiballistic package of several superimposed layers of, for example, woven fabrics made from aromatic polyamide fibers. In addition to woven fabrics, other flat-shaped structures such as nonwovens, knitted fabrics, or sheets can be used.

In employing aromatic polyamide fibers in this type of protective clothing, the antiballistic effectiveness is known to suffer when the protective clothing becomes wet. For this reason, it is customary to provide flat-shaped structures made from aromatic polyamide fibers with a water-repellent finish of fluorocarbon resins prior to subsequent processing into protective clothing, thus improving the antiballistic effect of the bullet- or splinter-resistant layers in the protective clothing under wet bombardment.

This wet process is conducted at great expense and is not completely harmless from an ecological aspect.

In a particularly advantageous manner, the process of the invention offers the opportunity to avoid this wet process and to perform finishing of the aromatic polyamide fibers that is cost-effective and easy on the environment. Woven fabrics made from aromatic polyamide fibers and treated using the process of the invention offer a significantly improved antiballistic effect, compared to untreated materials. This improvement is noted not only under wet bombardment; surprisingly, it has been discovered that, even under bombardment in the dry state, woven fabrics made from aromatic polyamide fibers and treated with the process of the invention exhibit improved antiballistic effectiveness. The data listed below clearly demonstrate this.

To test antiballistic effectiveness, a splinter bombardment can be undertaken, for example. This test method is particularly appropriate for protective clothing to be used preferably for military applications, since the antiballistic effectiveness in the wet state is more significant in this case than for protective clothing for police applications, for example.

To test the effectiveness against splinter bombardment, a total of 14 cutouts for vests are incorporated as a package and sewn together along the edges in preparation for the bombardment test. The antiballistic package so constructed is subjected to a splinter bombardment in accordance with the provisions of STANAG 2920. The bombardment is conducted with 1.1 g splinters. The protective action is expressed by the V50 value and given in speeds of m/sec. The V50 value means that the probability of penetration is 50% at the determined speed.

To test antiballistic effectiveness in the wet state, the test material in the form of the prepared antiballistic package is immersed in water for one hour. The bombardment is conducted after drip-drying for 3 minutes.

The clear improvement in antiballistic effectiveness using the process of the invention is demonstrated by the following V50 values. In this case, a comparison was conducted between an untreated fabric, a fabric made hydrophobic by conventional means in a wet process using a fluorocarbon resin, and a fabric treated with the process of the invention. During the plasma treatment, a first treatment stage in an argon plasma was employed. The second stage used a plasma of a mixture of 80% butadiene and 20% argon. The materials being treated in each case were fabrics made from aromatic polyamide fibers. The yarn titer of the filament yarns used for fabric manufacture was 1 100 dtex, and the plain-weave fabrics had a gray-cloth weight per unit area of 187 g/m$^2$.

| | V50 value | |
|---|---|---|
| | dry | wet |
| Untreated | 344 | 205 |
| Made hydrophobic by conventional means | 345 | 361 |
| Plasma-treated | 370 | 365 |

This table, which lists the averages of 6 bombardment trials, shows that the conventional wet hydrophobizing process using fluorocarbon resins shows no improvement in antiballistic effectiveness under dry bombardment compared to the untreated material. This agrees with the experience of manufacturers of such splinter-proof vests. In practice, even a decrease in antiballistic effectiveness is sometimes observed under dry bombardment after wet treatment with fluorocarbon resins. In contrast, using the process of the invention, there is a surprising improvement in antiballistic effectiveness even under dry bombardment as a result of the plasma treatment.

Under wet bombardment, the material treated with the process of the invention shows about the same antiballistic effectiveness as that hydrophobized using the conventional process.

The plasma treatment conditions in carrying out the process of the invention depend heavily on the material to be treated, the effect desired, and any additional pre- or post-treatments, and must be adapted to these factors accordingly. Other factors which influence the definition of the treatment conditions are the type of plasma, i.e., a DC plasma, low- or high-frequency AC plasma, the type of coupling of the plasma to the reaction zone (capacitive or inductive), the reactor size and geometry, the geometry of the electrodes, the material area to be treated per unit of time, and the position of the material in the reactor.

For the plasma treatment in accordance with the process of the invention, the temperature range of 10°–90° C. has proven appropriate. The temperature range from 20° to 50° C. is preferred. The treatment according to the process of the invention is not limited to the low-temperature plasma cited here, however. In high-temperature plasma—also called corona plasma—as well, a treatment can be conducted using the process of the invention. In this case, the pressure range between 100 Pa and 100 000 Pa is used, whereby higher temperatures are attained.

The power is selected between 5 and 1 000 W. The range between 20 and 600 W is preferred. The treatment can be conducted in DC as well as AC plasma. AC plasmas are preferred. In the latter case, high-frequency and low-frequency plasmas are equally suitable. Pressures between 0.1 and 100 Pa have proven advantageous, and the range from 1 to 10 Pa is preferred. These pressure specifications apply to the treatment in low-temperature plasma. Suitable pressures for corona plasmas are between 100 and 100 000 Pa.

There are no restrictions with respect to the inflow of the gas which forms the plasma. The gas can be fed parallel, perpendicular, or diagonal to the web. When using a continuous process, the flow can be in the same or opposite direction to that taken by the material being treated.

The retention time in the plasma chamber, which is essentially determined by the web speed in the continuous process, depends very heavily on the material being treated and the desired effect, the type of plasma (DC, low- or high-frequency AC plasma), the type of coupling (inductive or capacitive), the reactor size and geometry, the geometry of the electrodes, the surface area to be treated per unit of time, and the position of the treated material in the reactor. The retention time is further influenced by the ion density in the treatment chamber. At high ion densities, a reduction in retention time with the same effect is possible. Normally, a shorter retention time is required for the activating treatment in the first treatment stage in the plasma of an inorganic gas than for the treatment in the second stage in a plasma of a hydrophobically acting organic gas or in a mixture of a hydrophobically acting organic gas and an inorganic gas.

The process of the invention offers a particularly advantageous opportunity for plasma treatment of antiballistically effective materials, whereby the most important advantage is the attainment of improved antiballistic characteristics. This advantage is particularly evident under dry bombardment when compared to conventional finishing with fluorocarbon resins in a wet process. Compared to the wet process common up to now, the process of the invention, in addition to improving antiballistic effectiveness, is considerably simpler, offers improved economy, and most importantly has significantly less impact on the environment.

What is claimed is:

1. A process for plasma treatment of antiballistically effective materials, said plasma treatment comprising:

treating the antiballistically effective materials in a first stage treatment in a first plasma comprising at least 50% or at least one first inorganic gas, and treating the antiballistically effective materials in a second stage treatment in a second plasma comprising at least one hydrophobically acting organic gas selected from the group consisting of saturated hydrocarbons, unsaturated hydrocarbons, saturated fluorocarbons, unsaturated fluorocarbons, siloxanes, and vinyl compounds, or a mixture of at least one hydrophobically acting organic gas and at least one second inorganic gas.

2. Process in accordance with claim 1, wherein said at least one first inorganic gas or said at least one second inorganic gas comprises at least one gas selected from the group consisting of oxygen, nitrogen, hydrogen, and noble gases.

3. Process in accordance with claim 1, wherein said at least one first inorganic gas of said at least one second inorganic gas is argon.

4. Process in accordance with claim 1, wherein said at least one hydrophobically acting organic gas is at least one gas selected from the group consisting of alkanes, alkenes, alkynes, dienes, trienes, cumulenes, and corresponding fluorine-containing compounds in which fluorine atoms are substituted for at least one hydrogen atom.

5. Process in accordance with claim 1, wherein said at least one hydrophobically acting organic gas is selected from the group consisting of siloxanes and vinyl compounds.

6. Process in accordance with claim 1, wherein the first plasma further comprises at least one hydrophobically acting organic gas.

7. Process in accordance with claim 1, wherein the second plasma excludes said at least one first inorganic gas.

8. Process in accordance with claim 1, wherein the second plasma comprises a mixture of said at least one hydrophobically acting organic gas and said at least one first inorganic gas.

9. Process in accordance with claim 1 wherein the antiballistic materials to be treated comprise aromatic polyamides, present in the form of yarns, yarn sheets, slivers, sheets, or flat-shaped textile structures.

10. Process in accordance with claim 1 wherein the antiballistic materials to be treated are in the form of woven fabrics made from aromatic polyamide fibers.

11. Process in accordance with claim 1, wherein the antiballistic materials to be treated comprise polyethylene fibers spun using the gel spinning process or yarns, yarn sheets, slivers, woven fabrics, knitted fabrics, non wovens or thread composites made from said fibers.

12. Method for manufacturing protective clothing, said method comprising providing a flat-shaped structure of antiballistically effective material, and treating said structure in accordance with the process according to claim 1.

13. Process in accordance with claim 1, wherein said at least one first inorganic gas or at least one second inorganic gas is helium.

14. Process in accordance with claim 1, wherein said flat-shaped textile structures are selected from the group consisting of woven fabrics, knitted fabrics, non-wovens and thread composites.

15. Method in accordance with claim 12, wherein said protective clothing is bullet- and splinter-resistant.

16. The process in accordance with claim 1, wherein the plasma treatment is a continuous process.

17. The process in accordance with claim 1, wherein the plasma treatment is a discontinuous process.

18. Flat-shaped textile structure comprising at least one of aromatic polyamide fibers and polyethylene fibers, wherein said polyethylene fibers are spun using a gel spinning process and treated in accordance with claim 1.

19. Protective clothing comprising a flat-shaped structure of antiballistically effective materials treated in accordance with claim 1.

20. Protective clothing in accordance with claim 17, wherein said protective clothing is bullet- and splinter-resistant.

* * * * *

UNITED STATES PATENT AND TRADEMARK OFFICE

CERTIFICATE OF CORRECTION

PATENT NO. : 5,622,773

DATED : April 22, 1997

INVENTOR(S) : Andreas REINER, Dieter H.P. SCHUSTER, and Achim G. FELS

It is certified that error appears in the above-indentified patent and that said Letters Patent is hereby corrected as shown below:

Col. 7, line 33, change "or" to --of--.
Claim 3, line 2, change "of" to --or--.
Col. 8, line 18, after "1" insert --,--;
Col. 9, line 3, delete "present".
Claim 10, line 1, after "1" insert --,--.
Claim 11, line 3, change "the" to --a--.
Claim 14, line 1, change "1" to --9--.
Claim 20, line 1, change "17" to --19--.

Signed and Sealed this

Ninth Day of September, 1997

Bruce Lehman

*Attest:*

BRUCE LEHMAN

*Attesting Officer*

*Commissioner of Patents and Trademarks*